US008161709B2

(12) United States Patent
Saurey et al.

(10) Patent No.: US 8,161,709 B2
(45) Date of Patent: Apr. 24, 2012

(54) METHOD OF MAKING AN ENDWALL OVERHANG

(75) Inventors: Tom Saurey, Littleton, CO (US); Owen Woodruff Bunker, II, Aurora, CO (US)

(73) Assignee: Tuff Shed, Inc., Denver, CO (US)

( * ) Notice: Subject to any disclaimer, the term of this patent is extended or adjusted under 35 U.S.C. 154(b) by 0 days.

(21) Appl. No.: 12/539,296

(22) Filed: Aug. 11, 2009

(65) Prior Publication Data

US 2009/0293416 A1 Dec. 3, 2009

Related U.S. Application Data

(62) Division of application No. 12/026,974, filed on Feb. 6, 2008.

(51) Int. Cl.
*E04B 7/00* (2006.01)

(52) U.S. Cl. ..... 52/745.05; 52/93.2; 52/74; 52/96

(58) Field of Classification Search ..... 52/96, 91.2, 52/10, 93.2, 74, 262, 94, 745.05
See application file for complete search history.

(56) References Cited

U.S. PATENT DOCUMENTS

| | | | | |
|---|---|---|---|---|
| 219,786 | A | 9/1879 | Van Riper et al. | |
| 321,800 | A | 7/1885 | Delffs | |
| 397,534 | A | 2/1889 | Carroll | |
| 762,220 | A | 6/1904 | Williams | |
| 1,316,968 | A | 9/1919 | Neill et al. | |
| 1,504,454 | A | 8/1924 | Thomas | |
| 1,651,071 | A * | 11/1927 | Scheppers | 160/327 |
| 1,702,414 | A | 2/1929 | Richards | |
| 1,702,415 | A | 2/1929 | Richards | |
| 2,021,929 | A * | 11/1935 | Voigt | 52/277 |
| 2,070,648 | A | 2/1937 | Calkins et al. | |
| 2,200,031 | A * | 5/1940 | Lee | 454/365 |
| 2,255,315 | A | 9/1941 | Edmondston | |
| 2,396,828 | A * | 3/1946 | Carpenter | 52/92.3 |
| 2,473,400 | A * | 6/1949 | Waara | 24/290 |
| 2,530,567 | A | 11/1950 | Cline | |
| 2,542,151 | A | 2/1951 | McAuliffe, Jr. | |
| 2,602,968 | A | 7/1952 | Simon | |
| 2,849,966 | A | 9/1958 | Lechaire | |
| 3,012,376 | A * | 12/1961 | Reddy et al. | 52/96 |
| 3,024,573 | A | 3/1962 | McKinley | |

(Continued)

FOREIGN PATENT DOCUMENTS

JP 06146514 A 5/1994

*Primary Examiner* — William Gilbert
*Assistant Examiner* — James Ference
(74) *Attorney, Agent, or Firm* — Kilpatrick Townsend & Stockton LLP

(57) ABSTRACT

A method of making an endwall overhang for a structure is provided. The method may include providing a roof piece, a first trim piece, and a lengthwise member. The method may also include forming an overhang assembly by coupling the roof piece with a first surface of the lengthwise member and coupling the first trim piece with a second surface of the lengthwise member. The method may further include providing a structure and coupling a support member with the outside surface of an endwall of the structure, with the support member protruding from the endwall. The method may thereafter include coupling the overhang assembly to the structure by coupling the roof piece of the overhang assembly with a top support surface of the support member.

7 Claims, 10 Drawing Sheets

U.S. PATENT DOCUMENTS 3,054,481 A 9/1962 Johnson et al.
3,098,322 A * 7/1963 Greene ..... 52/11
3,160,987 A * 12/1964 Pinkley ..... 52/95
3,187,464 A * 6/1965 Sharp ..... 52/716.1
3,204,374 A * 9/1965 Hellekson ..... 52/94
3,240,144 A * 3/1966 Lind ..... 454/260
3,293,808 A * 12/1966 Duncan ..... 52/92.2
3,436,877 A * 4/1969 Gunning ..... 52/11
3,696,527 A 10/1972 Jureit
3,768,217 A 10/1973 Tyson
3,783,564 A 1/1974 Dunn et al.
3,797,180 A * 3/1974 Grange ..... 52/95
3,824,749 A * 7/1974 Scherf ..... 52/11
3,826,048 A * 7/1974 Merkin et al. ..... 52/11
3,972,164 A * 8/1976 Grange ..... 52/95
4,096,670 A 6/1978 Fuller
4,096,790 A * 6/1978 Curran ..... 454/260
4,102,092 A 7/1978 Ward
4,115,967 A * 9/1978 Kragt ..... 52/92.3
4,126,973 A * 11/1978 Luckey ..... 52/94
4,160,346 A 7/1979 Kaufmann
4,179,857 A * 12/1979 Danford ..... 52/71
4,189,878 A * 2/1980 Fitzgerald ..... 52/95
4,195,455 A * 4/1980 Chalmers et al. ..... 52/94
4,214,510 A * 7/1980 Ward ..... 454/260
4,222,315 A * 9/1980 Weirich ..... 454/260
4,254,594 A * 3/1981 Hammond et al. ..... 52/11
4,294,050 A 10/1981 Kandel
4,300,319 A * 11/1981 Frost et al. ..... 52/11
4,461,128 A * 7/1984 Knoebl ..... 52/94
4,481,744 A * 11/1984 Park ..... 52/92.1
4,573,293 A * 3/1986 Park ..... 52/92.1
4,601,135 A 7/1986 Ellis et al.
4,608,788 A 9/1986 Porter et al.
4,611,443 A * 9/1986 Jorgensen et al. ..... 52/95
4,665,667 A * 5/1987 Taylor et al. ..... 52/96
4,776,262 A * 10/1988 Curran ..... 454/260
4,780,999 A * 11/1988 Webb et al. ..... 52/96
4,894,964 A * 1/1990 Thrift et al. ..... 52/93.1
4,903,394 A * 2/1990 Roberts ..... 29/458
5,016,404 A * 5/1991 Briggs ..... 52/12
5,031,367 A * 7/1991 Butzen ..... 52/60
5,042,549 A 8/1991 Roberts
5,299,395 A 4/1994 Smith et al.
5,335,462 A * 8/1994 Park ..... 52/95
5,359,816 A 11/1994 Iacouides
5,414,965 A * 5/1995 Kelley et al. ..... 52/60
5,540,015 A 7/1996 Anthony
6,272,797 B1 8/2001 Finger
6,484,461 B1 * 11/2002 Schofield ..... 52/300
7,076,923 B2 7/2006 Seldon
7,325,362 B1 2/2008 Rowland
7,367,163 B2 * 5/2008 Brochu et al. ..... 52/60
7,487,618 B2 * 2/2009 Lin ..... 52/84
7,647,730 B1 1/2010 Inzeo et al.
2003/0061771 A1 * 4/2003 Kintop ..... 52/97
2003/0192264 A1 10/2003 Boggs
2007/0204525 A1 * 9/2007 Bunker ..... 52/41
2007/0294960 A1 12/2007 Saurey
2009/0193726 A1 8/2009 Saurey et al.
2009/0293376 A1 12/2009 Saurey et al.

* cited by examiner

METHOD OF MAKING AN ENDWALL OVERHANG

BACKGROUND OF THE INVENTION

This application is a division of pending U.S. patent application Ser. No. 12/026,974, filed Feb. 6, 2008 and titled "Endwall Overhang", the entire disclosure of which is hereby incorporated herein by reference for all purposes.

This invention relates in general to construction of buildings. More specifically, the invention relates to construction of endwall overhangs for buildings.

Endwall overhangs are common on many types of buildings, and extend the length of the roof of a building some distance beyond the walls of the underlying building. Like eaves, endwall overhangs may provide both aesthetic appeal and keep water run-off at least a nominal distance from the building's walls. Water that falls near the walls may, over time, damage the walls and/or base of the building.

Endwall overhangs may be constructed by making a roof longer than the underlying building so it overhangs the endwalls, and then reinforcing the overhang by adding structure underneath. This type of construction may be problematic. For example, adding the reinforcing structure may force builders to work in uncomfortable or inefficient positions such as from elevated positions underneath the overhang. Further, it may be more difficult to use standard-size building materials for both the roof and the walls if one must be wider than the other. Such construction methods may therefore be expensive and time consuming.

Embodiments of the present invention may provide solutions to these and other issues.

BRIEF DESCRIPTION OF THE INVENTION

In one embodiment, a building with an endwall overhang is provided. The building may include a wall and a roof frame. The wall may have an inside facing inward to the structure and an outside facing outward from the structure, each of the inside and the outside comprising an upper region, and the roof frame may have a plurality of roof members. The building may further include at least one support member coupled with the upper region of the outside of the wall, where the support member protrudes outward from the structure and has a top support surface. The building may also have an overhang assembly, which includes a roof piece, a first trim piece, and a lengthwise member. Each of the roof piece and the trim piece has a first edge and a second edge, and the lengthwise member has a first surface and a second surface which are substantially orthogonal to one another. The roof piece may be coupled with the first surface, and the first trim piece may be coupled with the second surface. In some embodiments, the overhang assembly also includes a second trim piece, which may be coupled to a third surface of the lengthwise member. Further, the overhang assembly may be coupled with the structure by coupling the roof piece with the top support surface of the support member such that the roof piece is substantially parallel to the top support surface and the second edge of the roof piece may substantially overlaps the top support surface. In some embodiments, the building further includes an eave and the overhang assembly is shaped to match the silhouette of the eave.

In another embodiment, a method of making an endwall overhang for a building is provided. The method may include providing a roof piece, a first trim piece, and a lengthwise member; and forming an overhang assembly. Each of the roof piece and the trim piece may have a first edge and a second edge, and the lengthwise member may have a first surface and a second surface, which are substantially orthogonal to one another. Forming the overhang assembly may include coupling the roof piece with the first surface, and coupling the first trim piece with the second surface. In some embodiments, the method further includes providing a structure and coupling the overhang assembly with the structure. The structure may include a wall and a roof frame. The wall may have an inside facing inward to the structure and an outside facing outward from the structure, each of the inside and the outside comprising an upper region, and the roof frame may have a plurality of roof members. The building may further include at least one support member coupled with the upper region of the outside of the wall, where the support member protrudes outward from the structure and has a top support surface. In these embodiments, the roof piece may be coupled with the top support surface such that the roof piece is substantially parallel to the top support surface and the second edge of the roof piece substantially overlaps the top support surface. In certain embodiments, the support member is a portion of the roof frame that extends outward from the structure past the wall.

In yet another embodiment, a kit for making a building with an endwall overhang is provided. The kit may include a number of frame and siding members which may be assembled to form a structure with a wall and a roof frame. The wall may include an inside facing inward to the structure and an outside facing outward from the structure, each of the inside and the outside comprises an upper region; and the roof frame may include roof members, each roof member including at least one of the plurality of frame members. The kit may further have an overhang assembly including a roof piece, a first trim piece, and a lengthwise member. The lengthwise member may have a first surface and a second surface, the first surface and the second surface being substantially orthogonal. In the kit, the roof piece may be coupled with the first surface and the first trim piece may be coupled with the second surface. Further, the overhang assembly may be coupled with the structure by coupling the roof piece with a top support surface of at least one support member such that the roof piece is substantially parallel to the top support surface and the second edge of the roof piece substantially overlaps the top support surface. In some embodiments, the overhang assembly further includes a second trim piece which may be coupled with a third surface of the lengthwise member. In certain embodiments, the overhang assembly may be preassembled.

BRIEF DESCRIPTION OF THE DRAWINGS

The present invention is described in conjunction with the appended figures.

Figure 1:
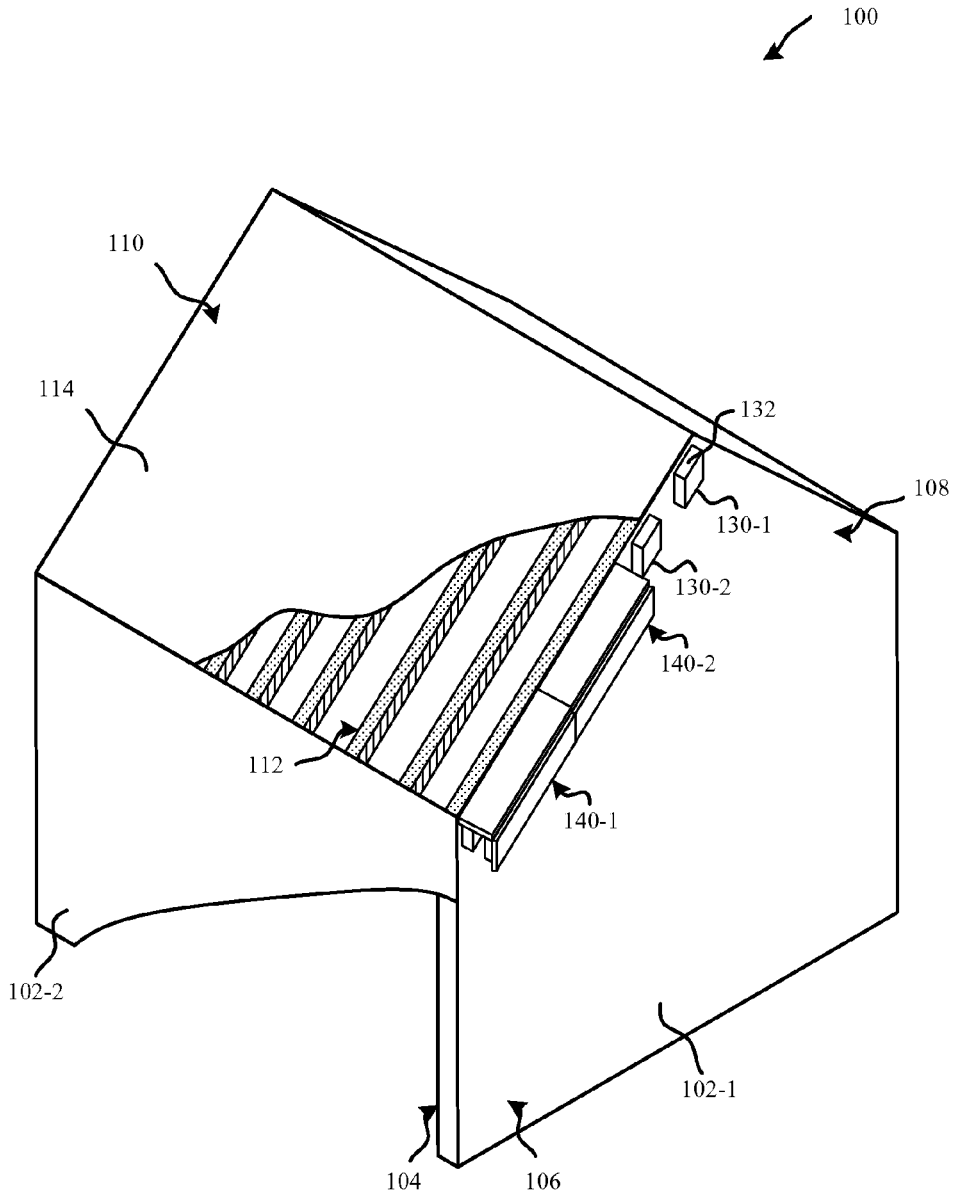
FIG. 1 provides an axonometric view of a building having an overhang assembly of the invention.

In the appended figures, similar components and/or features may have the same numerical reference label. Further, various components of the same type may be distinguished by following the reference label by a hyphen and a second numeral that distinguishes among the similar components and/or features. If only the first numerical reference label is used in the specification, the description is applicable to any one of the similar components and/or features having the same first numerical reference label irrespective of the hyphenated suffix numeral.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing an exemplary embodiment. It will be understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, methods, processes, and other components may be shown in block diagram form in order not to obscure the embodiments in unnecessary detail. In other instances, well-known processes, structures, and techniques may be shown without unnecessary detail in order to avoid obscuring the embodiments.

Also, it is noted that individual embodiments may be described as a process which is depicted as a flowchart, a flow diagram, a structure diagram, or a block diagram. Although a flowchart may describe the operations as a sequential process, many of the operations can be performed in parallel or concurrently. In addition, the order of the operations may be re-arranged, or some operations may not be present in all embodiments. A process may be complete when its operations are completed, but could have additional steps not included in a figure. A process may correspond to a method, a procedure, etc.

For the purposes of this description, an "endwall overhang" may be defined as a part of a structure that extends outward from substantially the top of a side of a building or structure. The endwall overhang may not be an eave, but may be similarly ornamental or functional (for example, for protection from rain).

Coupling in any of the steps and/or embodiments of the invention may, merely by way of example, include fastening with nails, fastening with screws, fastening with nuts and bolts, fastening with rivets, fastening with glue, fastening with staples and/or fastening with woodworking joints (for example, dowel, dovetail, and/or finger joints). The various structural components of the invention may, merely by way of example, be made from oriented strand board, particle board, fibreboard, plywood, structurally insulated panels, siding material, vented soffit material, wood, cement board, composite, plastic, polymer, metal, or any other suitable material.

In some embodiments, the support members, lengthwise members and other components may, merely by way of example, be cut from, or otherwise include, 2-by-4 softwood lumber. As known in the art, a 2×4 piece of softwood lumber has a cross section with actual dimensions of about 1½ inches (3.8 centimeters) by about 3½ inches (8.9 centimeters). In other embodiments, the support members, lengthwise members and other components may, merely by way of example, be cut from, or otherwise include softwood lumber having dimensions of: about 1½ inches (3.8 centimeters) by about 2½ inches (6.4 centimeters); about 1½ inches (3.8 centimeters) by about 1½ inches (3.8 centimeters); about 1 inch (2.5 centimeters) by about 1 inch (2.5 centimeters); and/or about 1½ inches (3.8 centimeters) by about 5½ inches (14.0 centimeters). Trim pieces may, merely by way of example, be cut from lumber with a width of about 1½ inches (3.8 centimeters) to about 24 inches (61.0 centimeters), and in some cases, either about 3½ inches (8.9 centimeters) or about 5½ inches (14.0 centimeters). Roof pieces may, merely by way of example, be cut from lumber with a width of about 1½ inches (3.8 centimeters) to about 48 inches (121.9 centimeters), and in some cases, either about 3½ inches (8.9 centimeters) or about 5½ inches (14.0 centimeters). The thickness of roof and/or trim pieces may be about ¼ of an inch (0.64 centimeters) to about 1½ of an inch (3.8 centimeters), and in some cases may be about ½ of an inch (1.3 centimeters). In embodiments where the roof and/or trim pieces are fabricated from vinyl and/or metal, the thickness of the pieces may be about ⅛ inches (0.32 centimeters) or less.

In a set of embodiments, a building with an endwall overhang is provided. The building may include a structure with a wall and a roof frame. The wall may have an inside facing inward to the structure and an outside facing outward from the structure, with each of the inside and the outside possibly having an upper region. The roof frame may have a plurality of roof members. The building may also include at least one support member coupled with the upper region of the outside of the wall, where the support member may protrude outward from the structure and may have a top support surface. The building may further have an overhang assembly, possibly including a roof piece, a first trim piece, and a lengthwise member. Each of the roof piece and the trim piece may have a first edge and a second edge; and the lengthwise member may have a first surface and a second surface, which may be substantially orthogonal. The roof piece may be coupled with the first surface, and the first trim piece may be coupled with the second surface. The overhang assembly may be coupled with the structure by coupling the roof piece with the top support surface of the support member such that the roof piece is substantially parallel to the top support surface and the second edge of the roof piece substantially overlaps the top support surface.

In some embodiments, at least a portion of the first edge of the first trim piece may overlap at least a portion of the first edge of the roof piece. In other embodiments, the outside of the wall may have siding. In these embodiments, the support member may be coupled with the upper region of the outside of the wall by coupling the support member with the siding. In certain of these embodiments, at least a portion of the second edge of the roof piece may overlap at least a portion of the siding and/or the wall frame. In yet other embodiments, at least one of the roof members may include a length which extends outward from the structure past the wall, and the support member may include at least a portion of the length.

In some embodiments, the at least one support member may include a first support block and a second support block, each support block possibly having a top support block surface. In these embodiments, the top support block surface of the first support block may be substantially coplanar with the top support block surface of the second support block, and the top support surface may include at least a portion of the top support block surfaces. In other embodiments, the lengthwise member may include a first lengthwise block and a second lengthwise block, each lengthwise block having a lengthwise block surface. In these embodiments, the lengthwise block surface of the first lengthwise block may be substantially coplanar with the lengthwise block surface of the second lengthwise block, and the first surface of the lengthwise member may include at least a portion of the lengthwise block surfaces.

In some embodiments, the overhang assembly may further include a second trim piece having a first edge and a second edge. In these embodiments, the lengthwise member may further include a third surface, where the third surface of the lengthwise member and the second surface of the lengthwise member may be in planes which form a dihedral angle. Further, in these embodiments, the second trim piece may be coupled with the third surface of the lengthwise member. In certain of these embodiments, the dihedral angle between the third surface and the second surface may be substantially a right angle. In certain other of these embodiments, the second edge of the second trim piece may be substantially flush with the outside of the wall.

In some embodiments, the roof frame may define a roof plane and the top support surface may be substantially parallel to the roof plane. In other embodiments, the roof frame includes an eave, a cross section of the eave possibly defining an cave silhouette. In these embodiments, the overhang assembly may have an eave cap region, where at least a portion of the cave cap region may be coupled with a side of the cave. Further, in these embodiments, the first trim piece may include an cave cap trim region, with at least a portion of the cave cap trim region possibly being shaped substantially to match the cave silhouette.

In another set of embodiments, a method of making an endwall overhang for a building is provided. The method may include providing a roof piece, a first trim piece, and a lengthwise member; and forming an overhang assembly. Each of the roof piece and the trim piece may have a first edge and a second edge, and the lengthwise member may have a first surface and a second surface that are orthogonal. The overhang assembly may be formed by coupling the roof piece with the first surface, and coupling the first trim piece with the second surface.

In some embodiments, the method may further include providing a structure. The structure may include a wall and a roof frame. The wall may have an inside facing inward to the structure and an outside facing outward from the structure, with each of the inside and the outside possibly having an upper region. In these embodiments, the method may further include coupling at least one support member with the upper region of the outside of the wall, where the at least one support member may protrude outward from the structure and may have a top support surface. In these embodiments, the method may even further include coupling the roof piece with the top support surface such that the roof piece may be substantially parallel to the top support surface and the second edge of the roof piece may substantially overlap the top support surface. In certain of these embodiments, the roof frame may define a roof plane and the top support surface may be substantially parallel to the roof plane. In some embodiments, the roof piece may extend substantially past the support block such that it may be coupled with any one or more of any of the roof support members or trusses.

In some embodiments, the method may further include providing a structure. The structure may include a wall and a roof frame. The wall may have an inside facing inward to the structure and an outside facing outward from the structure, each of the inside and the outside possibly having an upper region. The roof frame may include at least one support member, where the at least one support member may be a portion of the roof frame that extends outward from the structure past the wall, and may have a top support surface. In these embodiments, the method may further include coupling the roof piece with the top support surface such that the roof piece may be substantially parallel to the top support surface and the second edge of the roof piece may substantially overlap the top support surface.

In some embodiments, the method may further include providing a second trim piece that has a first edge and a second edge. In these embodiments, the lengthwise member further may include a third surface, the third surface and the second surface possibly being in planes which form a dihedral angle. The second trim piece may be coupled with the third surface. In certain of these embodiments, the dihedral angle between the third surface and the second surface may be substantially a right angle.

In yet another set of embodiments, a kit for making a building with an endwall overhang is provided. The kit includes a plurality of frame and siding members which may be assembled to form a structure with a wall and a roof frame. The assembled wall includes an inside facing inward to the structure and an outside facing outward from the structure, and each of the inside and the outside has an upper region. The assembled roof frame includes a plurality of roof members, each roof member including at least one of the plurality of frame members. The kit further includes an overhang assembly. The overhang assembly includes a roof piece, a first trim piece, and a lengthwise member. The lengthwise member has a first surface and a second surface, which are substantially orthogonal. The roof piece may be coupled with the first surface, and the first trim piece may be coupled with the second surface. The overhang assembly may be coupled with the structure by coupling the roof piece with a top support surface of at least one support member such that the roof piece may be substantially parallel to the top support surface and the second edge of the roof piece may substantially overlap the top support surface.

In some embodiments, the overhang assembly may further include a second trim piece including a first edge and a second edge. In these embodiments, the lengthwise member further may have a third surface, the third surface and the second surface possibly being in planes which form a dihedral angle. The second trim piece may be coupled with the third surface. In some other embodiments, the overhang assembly may be preassembled.

In some embodiments, the kit may further include instructions. The instructions may instruct a user to preassemble the overhang assembly prior to coupling the overhang assembly with the support member on the endwall of the structure. Various other possible instructions are also possible, including those instructing a user to couple any of the aforementioned components with each other prior to coupling with other aforementioned components.

Turning now to FIG. 1, an isometric view of a building 100 having an endwall overhang of the invention is shown. The building has walls 102 and a roof 110. Wall 102-1 is an endwall of the building 100, and has an inside 104, an outside 106, and an upper region 108. The roof 110 is made up of structure, including a roof covering 114 which is shown cut away to reveal a number of roof members 112. In some embodiments, the roof covering 114 includes a layer of plywood, covered by a layer of tar paper and shingles. In various embodiments, the angle of any portion of roof 110 compared to the ground, floor, or any other generally horizontal plane may be between about 9 degrees and about 80 degrees. For example, a barn style building may have a steep roof angle, (a "gambrel" style roof) whereas a ranch style building may have a shallow roof angle (a "gable" style roof). In some embodiments, the slope of the roof may be different in different portions, for example on gambrel or barn-style roofs.

A number of support members 130 are coupled with the upper region 108 of the wall 102-1. Each of the support members 130 has a top support surface 132. A number of overhang assemblies 140 have been coupled with the support blocks 130 on the upper region 108 of the wall 102-1.

Figure 2:
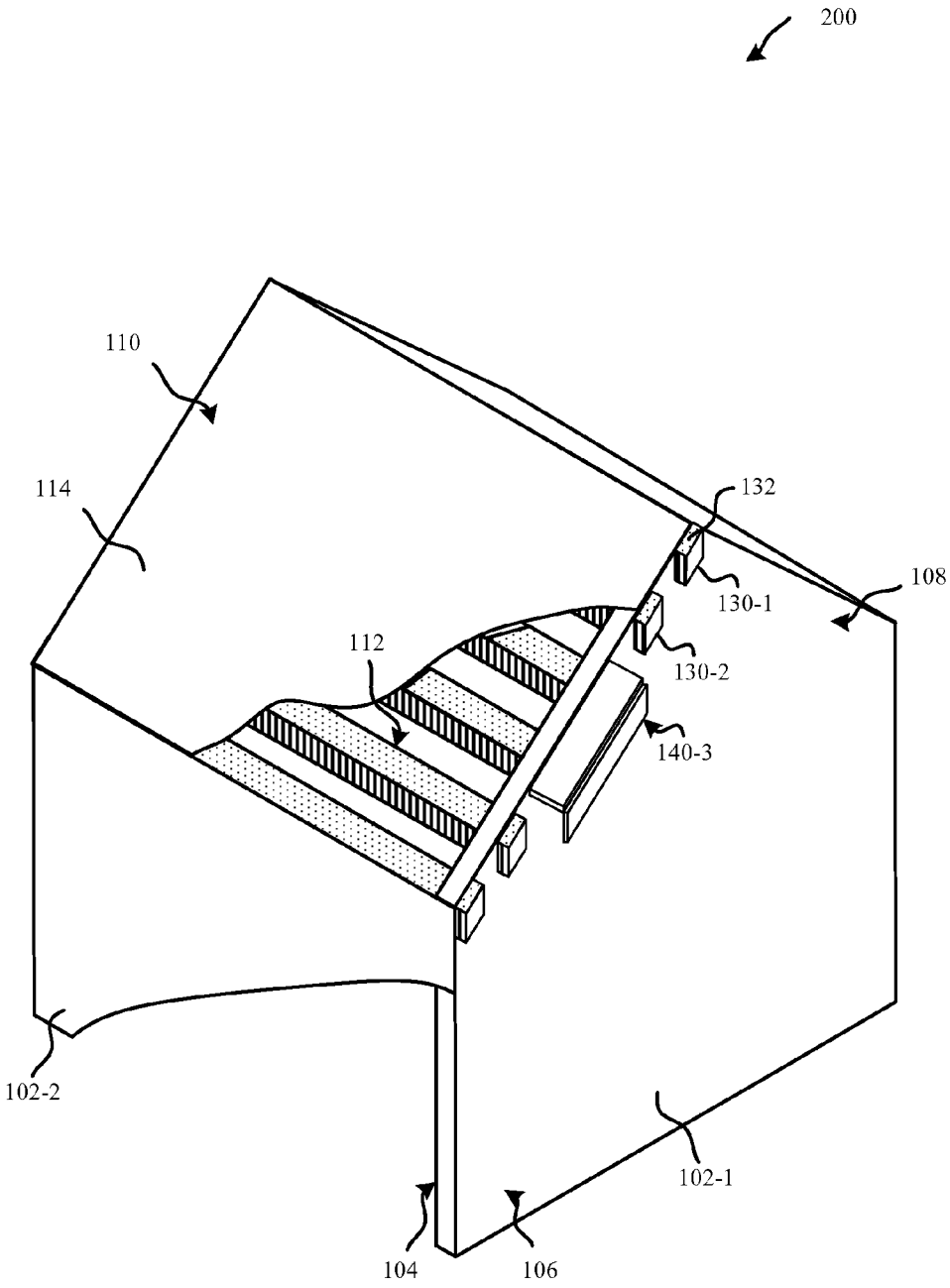
FIG. 2 provides an axonometric view of a building having an overhang assembly of the invention.

In some embodiments, the roof members 112 run parallel to the slope of the roof 110, as shown in FIG. 1. In other embodiments, a different building might have roof members 112 running orthogonal to the slope of the roof 110, as shown in building 200 of FIG. 2. In FIG. 2, the roof members 112 may extend past the wall 102-1 to form the support blocks 130. In this way, the support members are coupled with the wall 102-1. As in FIG. 1, an overhang assembly 140-3 is coupled with some of the support blocks 130.

Figure 3A:
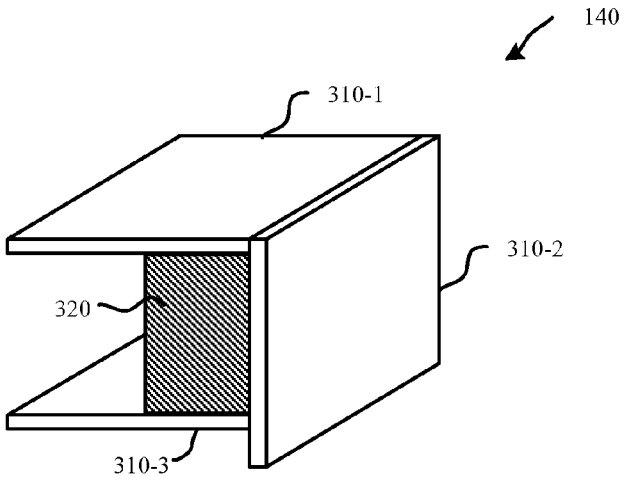
FIG. 3A provides an axonometric view of an overhang assembly.
Figure 3B:
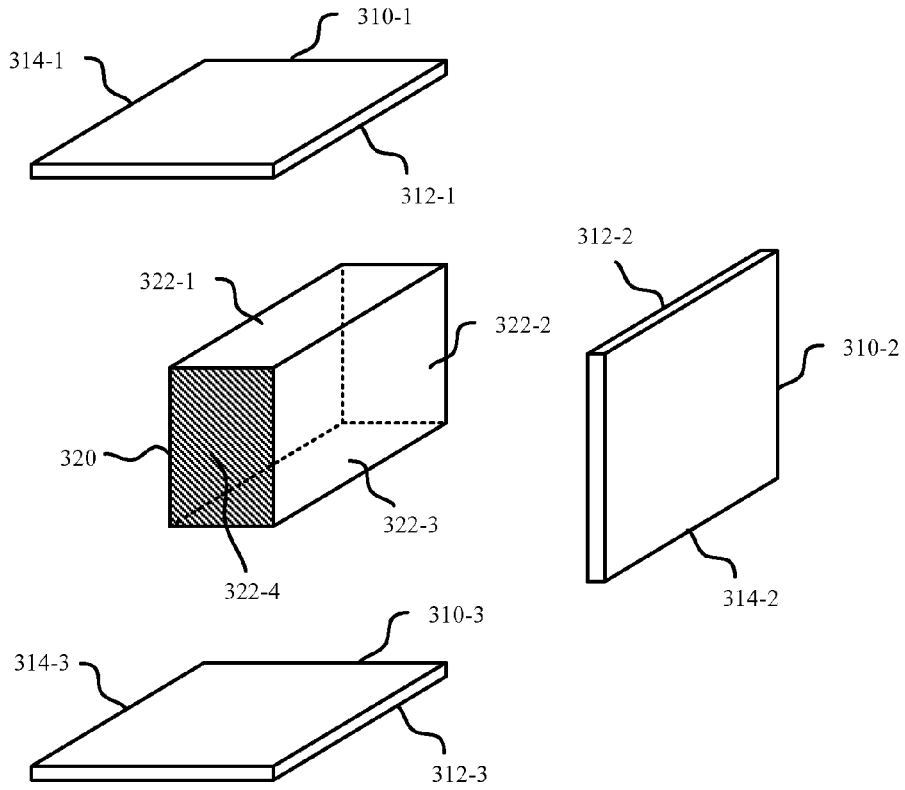
FIG. 3B provides an exploded view of the overhang assembly shown in FIG. 3A.

FIG. 3A provides an isometric view of an overhang assembly 140. FIG. 3B provides an exploded view of the overhang assembly 140 shown in FIG. 3A. The overhang assembly 140 includes a roof piece 310-1, a first trim piece 310-2, a second trim piece 310-3, and a lengthwise member 320. Each of the trim pieces 310 has a first edge 312 and a second edge 314.

The lengthwise member 320 has a first surface 322-1, a second surface 322-2, and a third surface 322-3. While the first surface 322-1 and the third surface 322-3 are illustrated as orthogonal to the second surface 322-2, this is not necessarily the case. In various embodiments, the surfaces may form angles to one another which are greater or less than ninety degrees. For example, the third surface 322-3 and the second surface 322-2 may form a dihedral angle 324 (see FIG. 4E and the discussion thereof, infra) which may be right, obtuse, or acute.

In some embodiments, the overhang assembly 140 is assembled by coupling the roof piece 310-1 to the first surface 322-1 of the lengthwise member 320, coupling the first trim piece 310-2 to the second surface 322-2 of the lengthwise member 320, and coupling the second trim piece 310-3 to the third surface 322-3 of the lengthwise member 320.

In various embodiments, the overhang assembly 140 may include different numbers of trim pieces 310, with different lengths and assembled in different ways. FIGS. 4A-4E provide cross-sectional views of some of these embodiments of overhang assemblies.

Figure 4A:
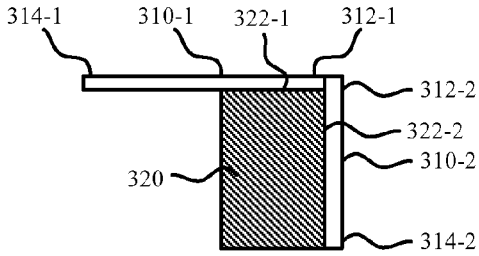
FIGS. 4A-4E provide cross-sectional views of embodiments of overhang assemblies of the invention.

FIG. 4A shows a cross-sectional view of an overhang assembly 140 with a roof piece 310-1, a first trim piece 310-2, and a lengthwise member 320. The roof piece 310-1 is coupled with the first surface 322-1 of the lengthwise member 320 and the first trim piece 310-2 is coupled with the second surface 322-2 of the lengthwise member 320. The first edge 312-1 of the roof piece 310-1 is substantially flush with the corner where the first surface 322-1 and the second surface 322-2 meet. The second edge 314-1 of the roof piece 310-1 extends far enough past the other side of the first surface 322-1 to provide room to couple the overhang assembly 140 to a building. The second edge 314-2 of the first trim piece 310-2 is substantially flush with the corner where the second surface 322-2 and the third surface 322-3 meet. The first edge 312-2 of the first trim piece 310-2 extends far enough past the other side of the second surface 322-2 to overlap the first edge 312-1 of the roof piece 310-1.

Figure 4B:
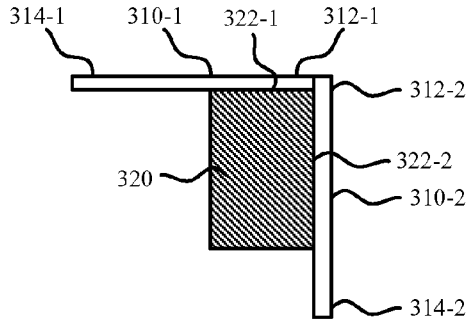

FIG. 4B shows a cross-sectional view of an overhang assembly 140 similar to the one shown in FIG. 4A. However, in FIG. 4B, the second edge 314-2 of the first trim piece 310-2 extends past the corner where the second surface 322-2 and the third surface 322-3 meet. This may provide an overlap, which may add to either or both of the aesthetic and functional characteristics of the overhang assembly 140.

Figure 4C:
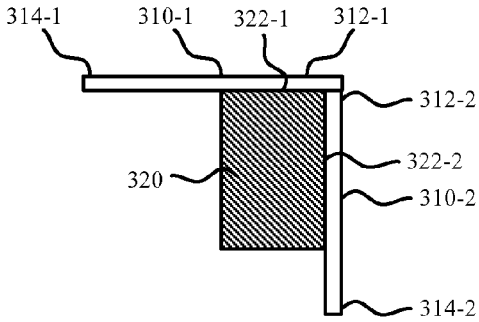

FIG. 4C shows a cross-sectional view of an overhang assembly 140 similar to the one shown in FIG. 4B. However, in FIG. 4C, the first edge 312-2 of the first trim piece 310-2 is substantially flush with the corner where the first surface 322-1 and the second surface 322-2 meet. The first edge 312-1 of the roof piece 310-1 extends past the corner where the first surface 322-1 and the second surface 322-2 meet to overlap the first edge 312-2 of the first trim piece 310-2. This may provide, for example, added protection from weather by shielding the joint between the roof piece 310-1 and first trim piece 310-2 from overhead exposure, as well as provide a taller fascia without using a wider first trim piece.

Figure 4D:
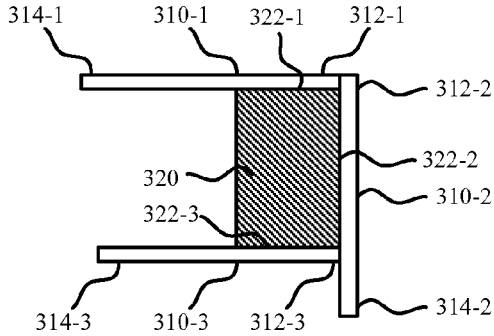

FIG. 4D shows another cross-sectional view of an overhang assembly 140 similar to the one shown in FIG. 4A, but further including a second trim piece 310-3. The second trim piece 310-3 is coupled with the third surface 322-3 and has a first edge 312-3 and a second edge 314-3. The first edge 312-3 of the second trim piece 310-3 is substantially flush with the corner where the second surface 322-2 and the third surface 322-3 meet. The second edge 314-3 of the second trim piece 310-3 extends past the other side of the third surface 322-3. This may provide, for example, a bottom trim to the overhang assembly 140 which is flush with a wall of the building, thereby shielding the inner structure of the overhang assembly 140 from exposure.

Figure 4E:
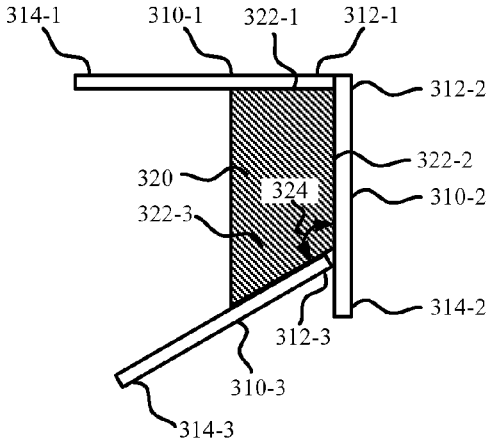

FIG. 4E shows a cross-sectional view of an overhang assembly 140 similar to the one shown in FIG. 4D. However, in FIG. 4E, the dihedral angle 324 between the second surface 322-2 and the third surface 322-3 is greater than ninety degrees. The second trim piece 310-3 is still coupled with the third surface 322-3, but is no longer substantially parallel with the roof piece 310-1.

Figure 5A:
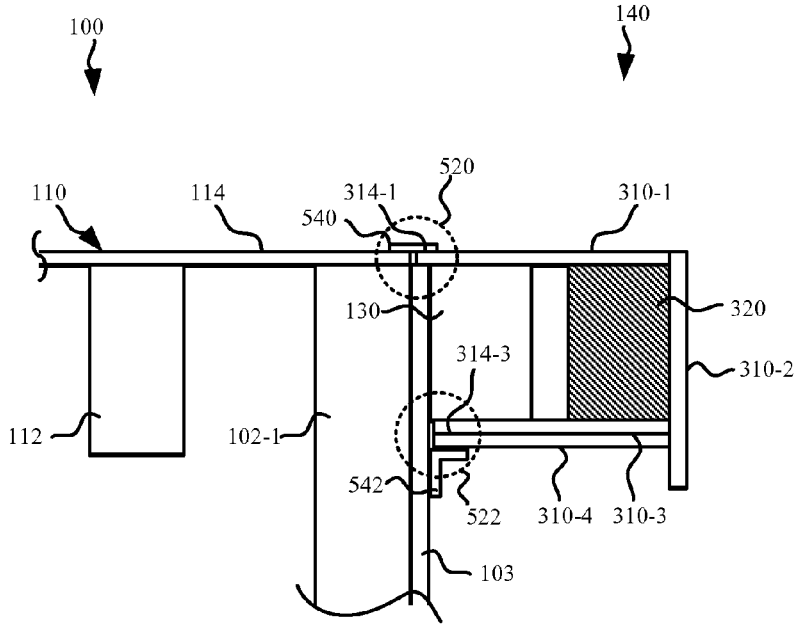
FIG. 5A provides a cross-sectional assembled view of a building with an overhang assembly similar to that shown in FIG. 4D.
Figure 5B:
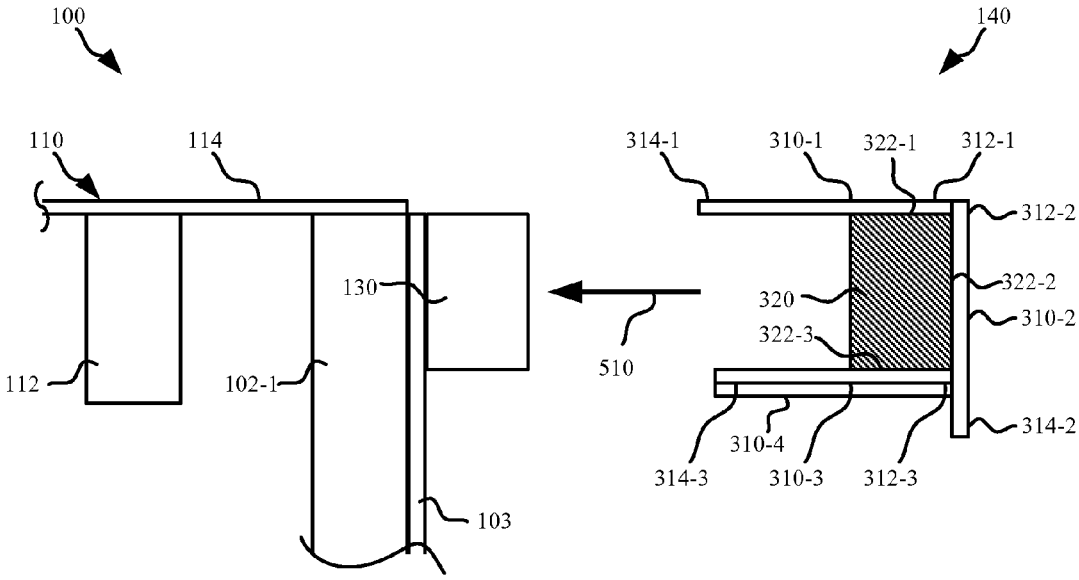
FIG. 5B provides a cross-sectional disassembled view of the building with the overhang assembly similar to that shown in FIG. 5A.

FIG. 5A provides a cross-sectional assembled view of a building 100 with an overhang assembly 140 similar to the one shown in FIG. 4D. FIG. 5B provides a cross-sectional disassembled view of the building 100 with the overhang assembly 140 shown in FIG. 5A.

The building 100 includes a wall 102-1 and a roof 110. The roof includes a roof covering 114 coupled with a plurality of roof members 112. The wall 102-1 includes siding 103. A plurality of support members 130 are coupled with the siding 103 of the wall 102-1.

The overhang assembly 140 includes a roof piece 310-1, a first trim piece 310-2, a second trim piece 310-3, and a lengthwise member 320. The roof piece 310-1 is coupled with the first surface 322-1, the first trim piece 310-2 is coupled with the second surface 322-2, and the second trim piece 310-3 is coupled with the third surface 322-3. Each of the trim pieces 310 has a first edge 312 and a second edge 314. The first edge 312-1 of the roof piece 310-1 is substantially flush with the corner where the first surface 322-1 and the second surface 322-2 meet. The second edge 314-1 of the roof piece 310-1 extends far enough past the other side of the first surface 322-1 to provide room to couple the overhang assembly 140 with one of the support members 130 on the building 100 when installed. The second edge 314-2 of the first trim piece 310-2 extends past the corner where the second surface 322-2 and the third surface 322-3 meet, forming a gable. The first edge 312-2 of the first trim piece 310-2 extends far enough past the other side of the second surface 322-2 to overlap the first edge 312-1 of the roof piece 310-1. The first edge 312-3 of the second trim piece 310-3 is substantially flush with the corner where the second surface 322-2 and the third surface 322-3 meet. The second edge 314-3 of the second trim piece 310-3 extends past the other side of the third surface 322-3 far enough to be flush with a wall 102-1 of the building 100 when installed. Further trim pieces 310 may be included by coupling the trim pieces to one or more of the other components of the overhang assembly 140. For example, a third trim piece 310-4 may be coupled with the second trim piece 310-3 for added aesthetic or functional appeal.

The overhang assembly 140 may be coupled with the building 100 by installing the overhang assembly 140, for example in the direction of arrow 510. As shown in FIG. 5A, once properly installed, the roof piece 310-1 may be coupled with one of the support members 130 on the building 100 such that the second edge 314-1 of the roof piece 310-1 is substantially flush with the roof covering 114 (see region 520). Further, once installed, the second edge 314-3 of the second trim piece 310-3 and the second edge 3144 of the third trim piece 310-4 may be substantially flush with the siding 103 of the wall 102-1 of the building 100 (see region 522).

Installation may be performed in any useful way and using any effective coupling hardware. For example, various chemical (e.g., glue) and/or mechanical fasteners (e.g., nails, screws, or staples) may be used to couple the roof piece 310-1 with any of the support members 130. Further hardware may be used to increase the efficacy of the installation. For example, a plurality of metal L-brackets 542 may be coupled with the second or third trim piece 310-4 and the siding 103 to increase the strength of the installation. Even further, other elements may be added to the installation for added functionality or aesthetics. For example, a rubberized strip 540 may be coupled to both the roof covering 114 and the roof piece 310-1 at region 520 to shield the seam from exposure to water. Of course, the roof covering 114 may also be extended to cover at least a portion of the overhang assembly 104.

Figure 6A:
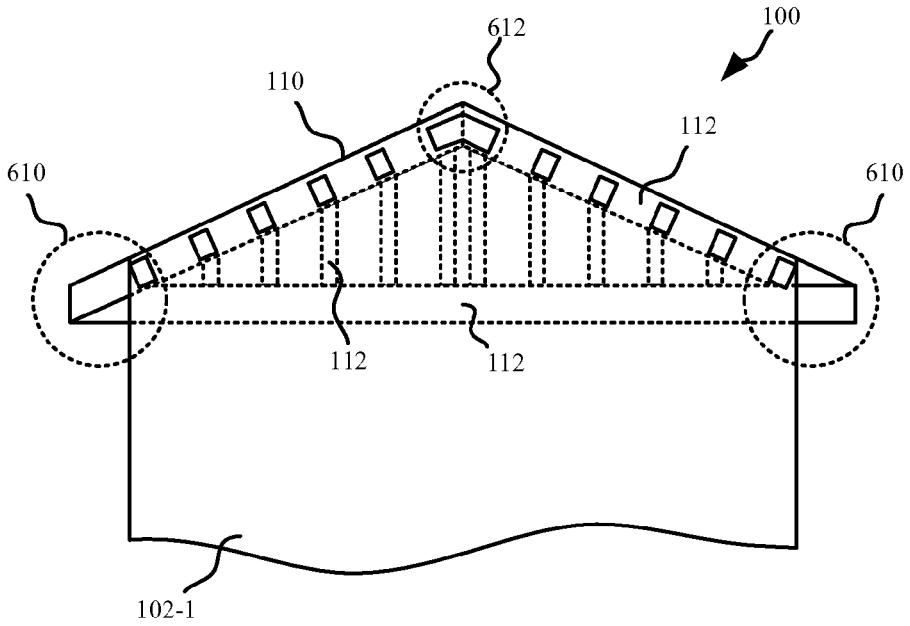
FIG. 6A provides a front view of a building having an eave and one overhang assembly of the invention.

FIG. 6A provides a front view of a building 100 having a wall 102-1 and a roof 110. The roof 110 of the building includes various types of roof members 112, for example trusses, situated in different orientations to form the shape and structure of the roof 110, including an eave 610. A portion of the wall 102-1 extends upward to cover some of the roof members 112. A plurality of support members 130 are coupled with the wall 102-1 in line with the shape of the roof 110.

It will be appreciated that an overhang assembly with a rectangular silhouette (like the one in FIG. 1) will not match the silhouette of the roof 110 in certain regions. In one example, at the upper-most region 612 of the roof 110, the silhouette of each side of the roof 110 may be substantially trapezoidal in shape. In another example, the eave 610 of the roof 110 may have a complex-shaped silhouette.

Figure 6B:
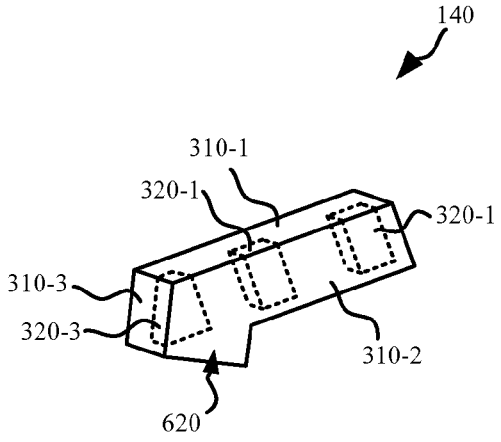
FIG. 6B provides an axonometric view of an overhang assembly of the invention for use with the building shown in FIG. 6A.

FIG. 6B provides an isometric view of an overhang assembly 140 of the invention for use with the building 100 shown in FIG. 6A. Specifically, the overhang assembly 140 is shaped to substantially follow the silhouette of the eave 610. By following the silhouette of the cave 610, the overhang assembly 140 may exhibit improved aesthetic and functional properties such as simple and secure coupling of the cave and overhang. Likewise, a support member near the apex of the roof (possibly constructed at least in part with a truss plate) may provide a simple method for aligning the overhang with the roof generally.

The overhang assembly 140 includes roof piece 310-1, first trim piece 310-2, lengthwise members 320-1, and cave pieces 310-3, 320-3. The roof piece 310-1 is coupled with a first surface 322-1 of the lengthwise members 320 and the first trim piece 310-2 is coupled with a second surface 322-2 of the lengthwise members 320 (see also FIG. 3B). The first trim piece 310-2 has a region 620 that is shaped to follow the silhouette of the cave 610 in FIG. 6A. The cave piece 310-3 is coupled with a fourth surface 322-4 of the third lengthwise/eave member 320-3. The cave trim piece 310-3 may serve to cap the overhang section 140 in the direction of the extension of the cave 610.

Figure 6C:
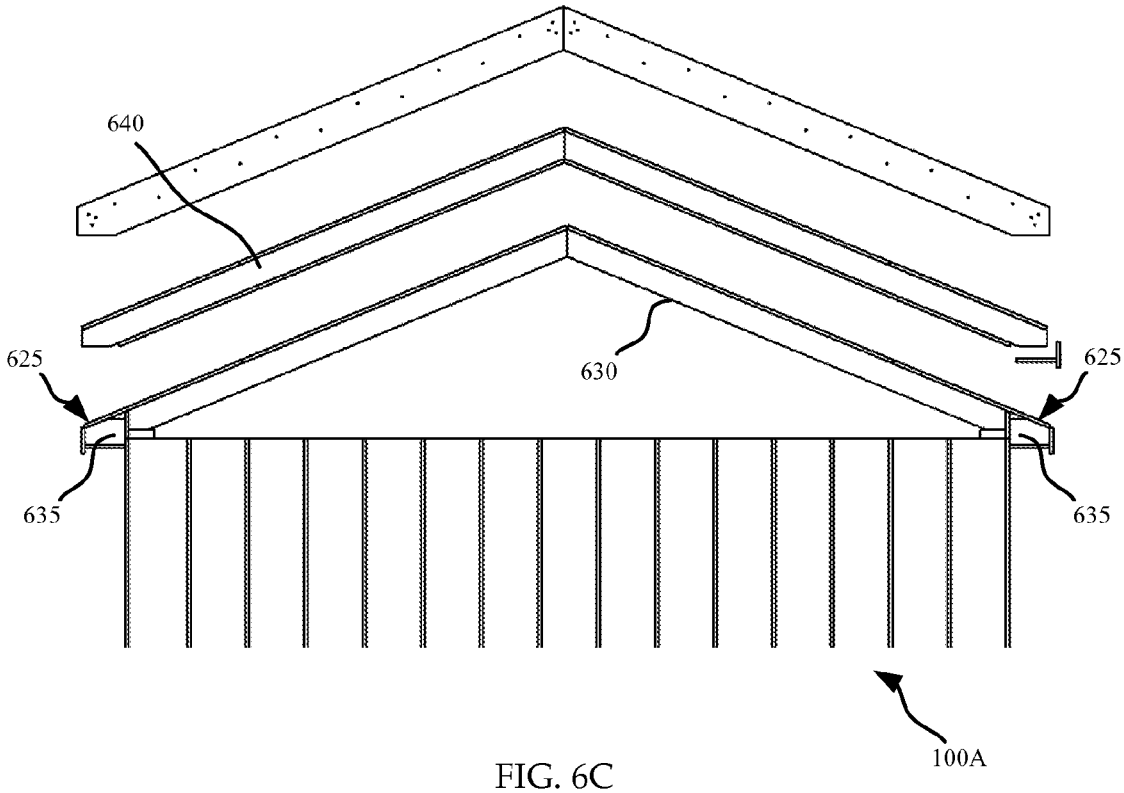
FIG. 6C provides a front view of a ranch style building having an overhang of the invention which matches the shape of the eaves on each side of the building.
Figure 6D:
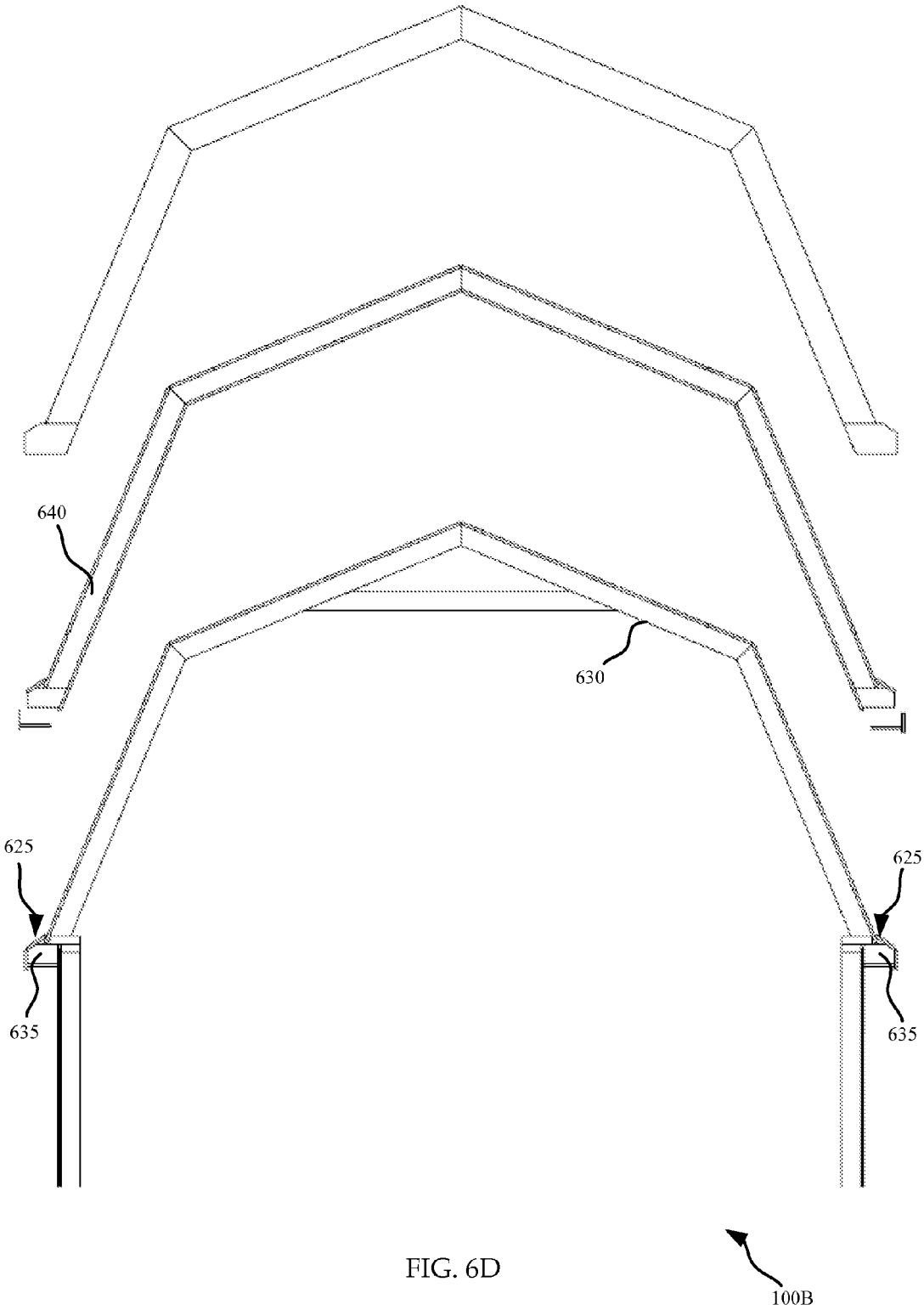
FIG. 6D provides a front view of a barn style building having an overhang of the invention which matches the shape of the eaves on each side of the building.

FIG. 6C provides a front view of a building 100A having an overhang of the invention which matches the shape of the eaves 625 on one or more sides of building 100A. Common rafters 630 are shown on the interior of building 100A. Eave blocks 635 on the exterior of building 100A allow for eaves 625 to be formed, and make it appear as if common rafters extend through the walls of building 100A to form an eave. In this embodiment, the lengthwise member may be a full sized overhang rafter 640. Full sized overhang rafter 640 may be preassembled with a truss plate at its peak, as common rafters 630 are also assembled. However, full sized overhang rafter 640 may be longer than common rafters 630 so as to match the total length and eave silhouette of common rafters 630 and eave blocks 635 combined. Using the full sized overhang rafter 640 as the lengthwise member, an overhang of the invention, possibly preassembled, may be coupled to building 100A, and ensure a matching roof silhouette between the overhang, the rest of the roof, and the eaves. FIG. 6D shows how with different style roofs, for example barn style roofs, full sized overhang rafter 640 may include multiple pieces to produce more complicated roof/overhang silhouettes.

Figure 7:
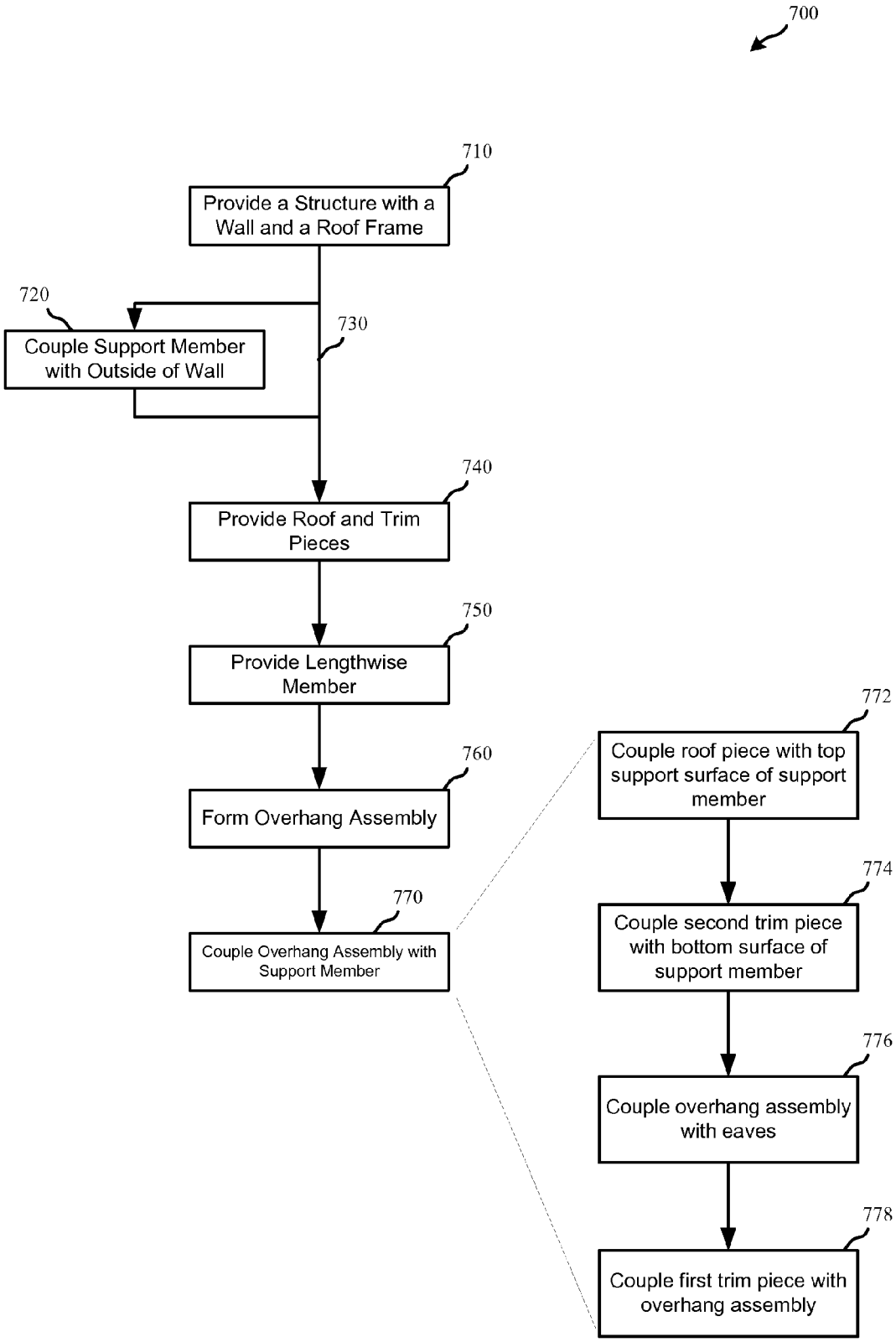
FIG. 7 provides a block diagram of a method of the invention for making a building with an overhang assembly.

FIG. 7 provides a block diagram of a method 700 of the invention for making a building with an overhang assembly. At block 710, a structure is provided which includes a wall and a roof frame. In some embodiments, a support member is coupled to the wall in block 720. In other embodiments, various roof members extend past the wall and are used as support members. These other embodiments require no additional step to create support members, as illustrated by arrow 730.

At block 740, roof and trim pieces are provided, and at block 750, a lengthwise member is provided. The elements provided at blocks 740 and 750 are then used to form an overhang assembly at block 760. In other embodiments, the overhang assembly may be preassembled. One embodiment for forming the overhang assembly in block 760 is expanded in FIG. 8, as discussed below.

The overhang assembly may then be coupled with a support member at block 770. The coupling in block 770 may be performed in any useful way. For example a roof piece may be coupled with a top support surface of a support member as in block 772; a second trim piece may be coupled with a bottom surface of a support member in block 774; and/or the overhang assembly may be coupled with the eaves in block 776. In some embodiments, at block 778 the first trim piece may be coupled with the overhang assembly when it was not already coupled thereto prior to coupling of the overhang assembly with the building.

Figure 8:
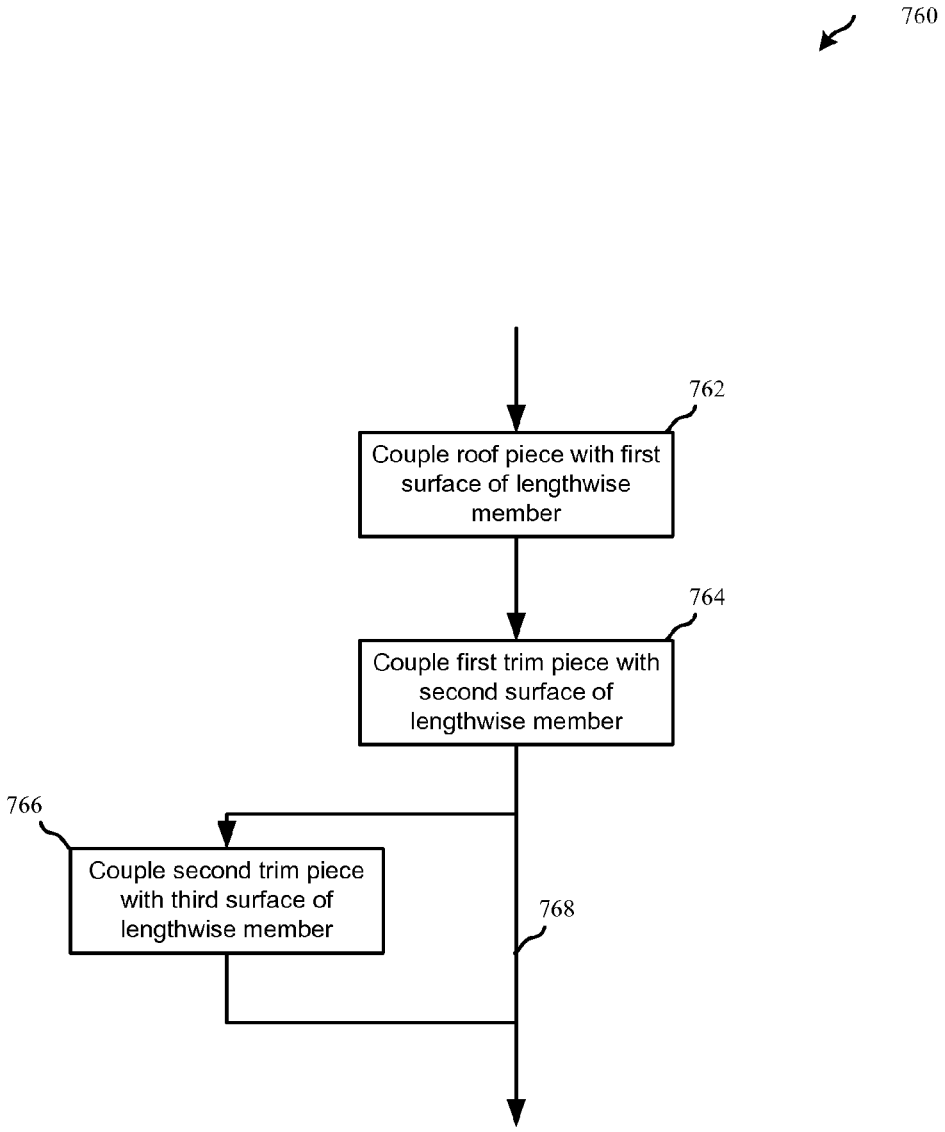
FIG. 8 provides a block diagram of a method of the invention for forming an overhang assembly, as shown in block of FIG. 7.

FIG. 8 provides a block diagram of a method 760 of the invention for making an overhang assembly, as shown in block 760 of FIG. 7. In block 762, the roof piece of the overhang assembly may be coupled with a first surface of the lengthwise member. Then, in block 764, the first trim piece may be coupled with a second surface of the lengthwise member. In some embodiments, a second trim piece may be coupled with a third surface of the lengthwise member, as in block 766. In other embodiments, the step in block 766 does not occur, as illustrated by arrow 768.

The invention has now been described in detail for the purposes of clarity and understanding. However, it will be appreciated that certain changes and modifications may be practiced within the scope of the appended claims.

What is claimed is:

1. A method of making an endwall overhang for a building, the method comprising:

providing a roof piece and a first trim piece, each of the roof piece and the first trim piece comprising a first edge and a second edge; and providing a lengthwise member comprising a first surface and a second surface, wherein the first surface and the second surface are substantially orthogonal;

forming an overhang assembly by:

coupling the roof piece with the first surface, wherein the roof piece is flush with the first surface; and coupling the first trim piece with the second surface;

providing a structure comprising:

an endwall comprising an inside facing inward to the structure and an outside facing outward from the structure, each of the inside and the outside comprising an upper region, the upper region of the outside forming a gable, and a roof frame;

coupling at least one solid support member with an outside surface of the gable of the outside of the endwall, wherein the at least one solid support member protrudes outward from the structure and comprises a top support surface; and subsequent to forming the overhang assembly and to coupling the solid support member with the outside surface of the gable of the outside of the endwall, coupling the overhang assembly to the structure by coupling the roof piece of the overhang assembly with the top support surface of the support member such that the roof piece is substantially parallel to the top support surface and the second edge of the roof piece substantially overlaps the top support surface, leaving a gap between the lengthwise member and the at least one support member.

2. The method of making an endwall overhang for a building of claim 1, wherein the roof frame defines a roof plane and the top support surface is substantially parallel to the roof plane.

3. A method of making an endwall overhang for a building, the method comprising:

providing a roof piece and a first trim piece, each of the roof piece and the first trim piece comprising a first edge and a second edge; and providing a lengthwise member comprising a first surface and a second surface, wherein the first surface and the second surface are substantially orthogonal;

forming an overhang assembly by:

coupling the roof piece with the first surface; and coupling the first trim piece with the second surface;

providing a structure comprising:

an endwall comprising an inside situated to face inward to the structure and an outside situated to face outward from the structure, each of the inside and the outside comprising an upper region and a lower region, the upper region of the outside forming a gable, and a roof frame comprising at least one solid support, wherein the at least one solid support member is a portion of the roof frame that extends outward from, and penetrates through, the endwall of the structure, and comprises a top support surface; and subsequent to forming the overhang assembly and to providing the structure, coupling the overhang assembly to the structure by coupling the roof piece of the overhang assembly with the top support surface of the support member such that the roof piece is substantially parallel to the top support surface and the second edge of the roof piece substantially overlaps the top support surface, leaving a gap between the lengthwise member and the at least one support member.

4. The method of making an endwall overhang for a building of claim 1, further comprising providing a second trim piece comprising a first edge and a second edge, and wherein:

the lengthwise member further comprises a third surface, the third surface and the second surface being in planes which form a dihedral angle; and the second trim piece is coupled with the third surface.

5. The method of making an endwall overhang for a building of claim 4, wherein the dihedral angle between the third surface and the second surface is substantially a right angle.

6. A method of making an endwall overhang for a building, the method comprising:

providing a roof piece and a first trim piece, each of the roof piece and the first trim piece comprising a first edge and a second edge; and providing a lengthwise member comprising a first surface and a second surface, wherein the first surface and the second surface are substantially orthogonal;

forming an overhang assembly by:

coupling the roof piece with the first surface; and coupling the first trim piece with the second surface;

providing a structure comprising:

an endwall comprising an inside facing inward to the structure and an outside facing outward from the structure, each of the inside and the outside comprising an upper region, the upper region of the outside forming a gable, and a roof frame;

coupling at least one solid support member with an outside surface of the gable of the outside of the endwall, wherein the at least one solid support member protrudes outward from the structure and comprises a top support surface; and subsequent to forming the overhang assembly and to coupling the solid support member with the outside surface of the gable of the outside of the endwall, coupling the overhang assembly to the structure by coupling the roof piece of the overhang assembly with the top support surface of the support member such that the first surface of the lengthwise member is substantially parallel with the top support surface and the second edge of the roof piece substantially overlaps the top support surface, leaving a gap between the lengthwise member and the at least one support member.

7. The method of making an endwall overhang for a building of claim 6, wherein the first surface of the lengthwise member being substantially parallel with the top support surface comprises the first surface of the lengthwise member being substantially coplanar with the top support surface.

* * * * *